United States Patent [19]

Hebert

[11] Patent Number: 4,540,370

[45] Date of Patent: Sep. 10, 1985

[54] RETRIEVER FOR SUBMERGED OBJECTS

[76] Inventor: Dellon Hebert, 257 Aline Dr., Breaux Bridge, La. 70517

[21] Appl. No.: 609,856

[22] Filed: May 14, 1984

[51] Int. Cl.[3] ..... B63B 21/52

[52] U.S. Cl. ..... 441/9; 441/23

[58] Field of Search ..... 441/7, 8, 9, 23, 24, 441/31, 98, 100; 116/209

[56] References Cited

U.S. PATENT DOCUMENTS

| | | | |
|---|---|---|---|
| 2,785,420 | 3/1957 | Kanaley | 441/9 X |
| 3,303,521 | 2/1967 | Mix | 441/9 |
| 3,407,418 | 10/1968 | May et al. | 441/9 |

*Primary Examiner*—Sherman D. Basinger
*Attorney, Agent, or Firm*—Keaty & Keaty

[57] ABSTRACT

A retriever for submerged objects is disclosed in which a cap is connected to a canister by a retrieval line, and the canister is in turn connected to an object by an anchoring line. When the object and attached canister are dropped into the water, the water dissolves a dissolvable seal over an aperture in the canister and water is permitted to flow into the interior of the canister and react with carbonate or carbide particles which evolve gas upon reacting with water. Before reaching the particles, however, the water must pass through a compressed cellulose sponge which assists in conveying water to the interior of the canister. The cellulose sponge also expands when damp to seal the aperture against the egress of the evolving gas. The bicarbonate or carbide particles are suspended in a desiccant to diminish the possibility that the water activatable particles will be slowly chemically reacted with atmospheric moisture prior to the time the canister is to be used. A window is also provided in the canister through which the contents of the canister may be viewed to determine if moisture has entered the canister and deactivated its contents.

10 Claims, 5 Drawing Figures

RETRIEVER FOR SUBMERGED OBJECTS

BACKGROUND OF THE INVENTION

1. Field of the Invention

This invention concerns retrievers for submerged objects, particularly retrievers comprised of a canister containing water activatable pellets that form a gas when exposed to water to force a floatable cap off of the cannister such that it will surface and mark the position of the submerged object. This invention also relates to improved seals for such canisters to permit the ingress of fluid into the container through an aperture while selectively sealing the aperture against the escape of gas which is evolved by the reaction between the water and the water activatable pellets inside the container.

2. Description of the Prior Art

U.S. Pat. No. 2,785,420 discloses a device for indicating sunken objects which is comprised of a cylindrical container in which a water activatable pellet is placed. Water enters the container by dissolving a water dissolvable seal, and gas evolved by a chemical reaction between the water and pellet forces a floatable cap off of the canister and to the surface of the water, thereby marking the position of the submerged object. This device most dramatically illustrates the drawbacks of the prior art in that the water activatable pellet can react with atmospheric moisture which enters the container without the dissolvable seal first being dissolved. Once the chemical reaction between the pellet and atmospheric moisture has taken place, the device is not functional, but a person using the device does not know it is not functional until an object is submerged beneath the water and the buoy cap does not rise to the surface. This is obviously much too late a time at which to remedy the problem.

Another drawback to the structure disclosed in U.S. Pat. No. 2,785,420 is that once the water dissolvable seal is dissolved, nothing prevents the evolving gas on the interior of the canister from merely escaping from the canister instead of forcing the plug out of the end of the cylinder and to the surface of the water. The disadvantages of this drawback are that the buoy may not be sent to the surface and the submerged object cannot be located.

SUMMARY OF THE INVENTION

It is accordingly an object of the present invention to provide a retriever for submerged objects in which means is provided for counteracting the slow decomposition of the water activatable material through the reaction with atomospheric or environmental moisture prior to submerging the canister.

Another object is to provide a means for determining if the water activatable material on the interior of the canister has already reacted so that the retriever will not be used.

A still further object of the invention is to provide a seal which will permit the ingress of fluid into the canister when it is submerged in water, but that will selectively seal the canister against the escape of gas which is evolving as a result of the water activatable pellets' reaction with water.

These objects have been achieved by providing a cylindrical canister having an open end in which a cap is placed. The cap is connected to the canister by a retrieval line, and the canister in turn is connected to an object by an anchoring line. When the object and attached canister are dropped into water, the water dissolves a dissolvable seal over an aperture in the canister and water is premitted to flow into the interior of the canister and react with bicarbonate or carbide particles which evolve a gas upon reacting with water. Before reaching the particles, however, the water must pass through a compressed cellulose sponge which assists in conveying water to the interior of the canister, yet which expands when damp to seal the aperture against the egress of the evolving gas. The bicarbonate or carbide particles are suspended in a desiccant, such as silica gel, to diminish the possibility that the water activatable particles will be slowly chemically reacted with atmospheric or environmental moisture prior to the time the canister is to be used. A window is also provided in the canister through which the contents of the canister may be viewed to determine if moisture has entered the canister and deactivated its contents.

DETAILED DESCRIPTION OF THE PREFERRED EMBODIMENT

Figure 5:
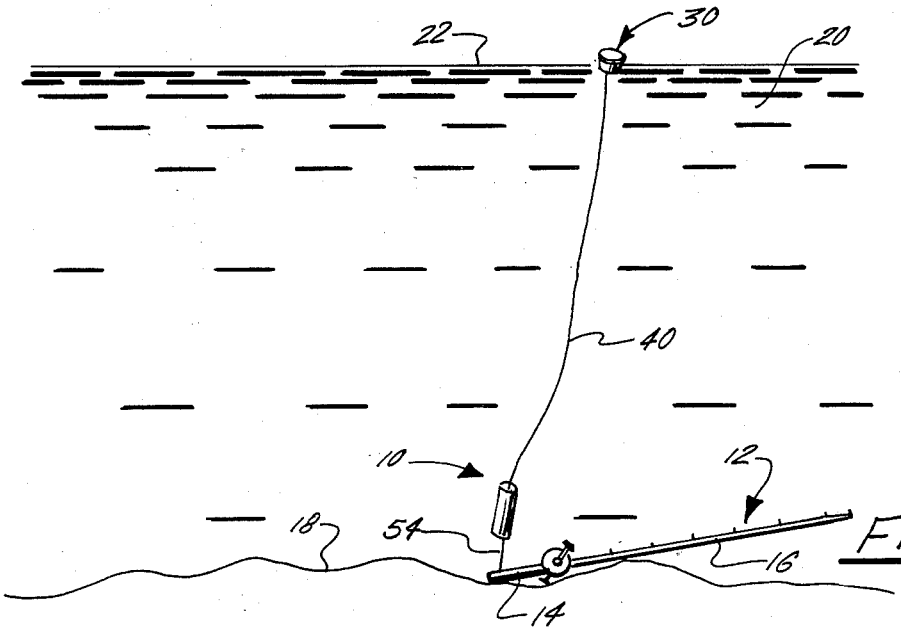
FIG. 5 is a view of the retriever in operation marking the place at which a fishing rod has been submerged.

Referring now to FIG. 5, a retriever 10 for a submerged object 12 is shown. The particular object being retrieved in FIG. 5 is a conventional fishing rod having a handle 14 and rod 16. The retriever is shown resting on the bottom 18 of a body of water 20 having a water surface 22.

Turning in more detail to retriever 10 (See FIGS. 1–4), it is comprised of a cylindrical canister 24 which is made of metal, plastic, or any other durable and preferably lightweight material which is substantially water impermeable. Canister 24 is comprised of circular base 26 and annular, upwardly extending side walls 28.

A floatable, polyurethane cap 30 is provided for placement in removably sealing relationship to the open end 34 of canister 24. The cap is comprised of a generally flat, circular top 32 and an annular downwardly depending skirt 36 which is configured to fit snugly within open end 34 of canister 24. The outer diameter of skirt 36 is great enough to fit tightly within end 34 and prevent the ingress of moisture to the interior of canister 24.

Figure 1:
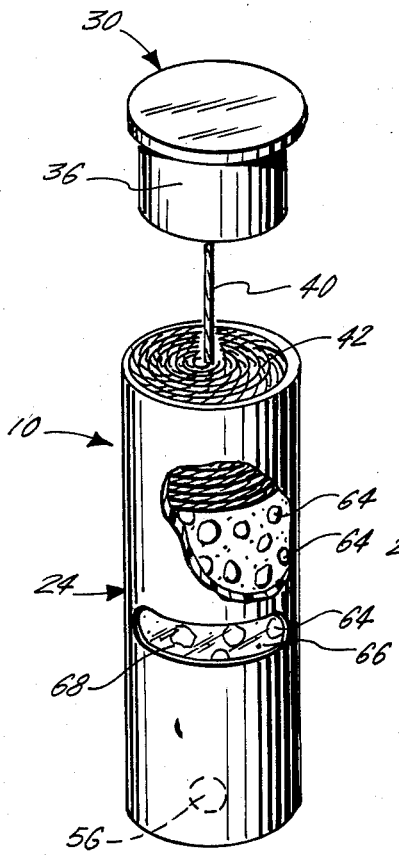
FIG. 1 is a perspective view of the retriever of the instant invention, portions of the wall of the canister being cut away for clarity, the cap having been removed from the canister to display the retrieval cord tightly wound within the canister, the aperture in the side wall of the canister being shown in phantom.
Figure 4:
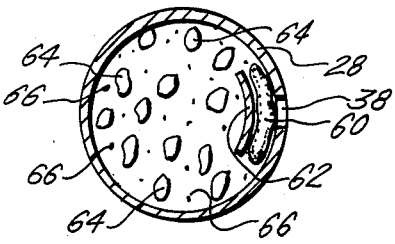
FIG. 4 is a view along section line 4—4 in FIG. 2.
Figure 2:
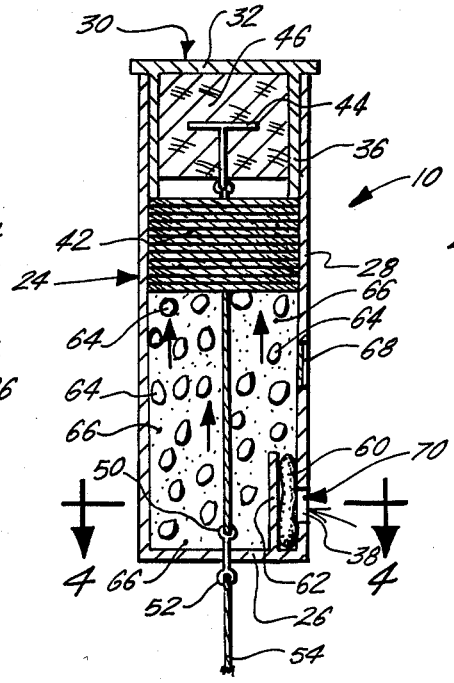
FIG. 2 is a cross-section of a canister as it would appear immediately after being submerged, with water entering through an aperture on which the latex seal has dissolved, the arrows at the aperture showing the ingress of moisture, the vertical arrows on the interior of the canister showing the evolution of carbon dioxide gas.
Figure 3:
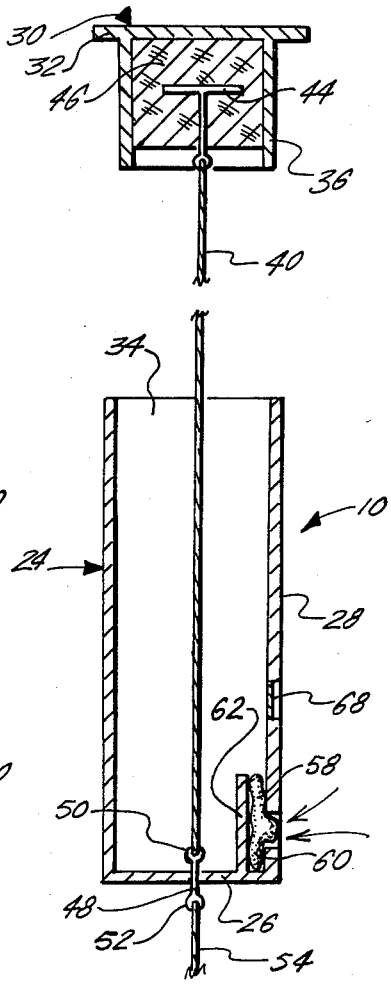
FIG. 3 is a cross-section similar to FIG. 2, portions of the cord being broken away for clarity, sufficient gas having evolved to push the cap off of the canister and to the surface of the water, the contents of the canister having been emptied into the water and the water-expandable sponge at the aperture having been forced into substantially sealing relationship with said aperture.

Canister 24 is further provided with an aperture 38, which is shown in phantom in FIG. 1, but which can more clearly be seen in FIGS. 2–4.

A retrieval cord 40 is made of nylon or other similar high-strength material and is wound into a coil 42 within canister 24 when canister 24 is in a stored condition prior to being submerged in water. Cord 40 is connected to cap 30 by means of an anchor 44 which is embedded within the polyurethane filing 46 which is placed within skirt 36. Cord 40 is connected at its other terminus to anchor pin 48 which has an internal eyelet 50 and external eyelet 52. Cord 40 is fixed within internal eyelet 50 thereby anchoring cap 30 to canister 24 at pin 48.

An anchor cord 54 is tied through outer eyelet 52 in order to fix said canister to submerged object 12. Cord 54 is tied or otherwise connected to object 12 as, for example, by securing it through a loop (not shown) on the handle 14 of object 12.

A first seal 56 (see FIG. 1) is provided over aperture 38 in the side wall 28 of canister 24. Said first seal is comprised, for example, of a latex coating over aperture 38 on the exterior of canister 34. Although a latex seal is shown in the preferred embodiment, any water dissolvable material can be employed in the invention.

A second seal 58 is comprised of a material that expands when soaked with water, for example a compressed cellulose sponge 60. Sponge 60 is disposed in abutting relationship to aperture 38 in the interior of canister 24 by providing a grated bracket 62 which is perpendicular to base 26 yet near side wall 28, thereby providing a chamber within which sponge 60 may be placed and maintained.

Water activatable pellets 64, which are made of materials such as calcium carbide or sodium bicarbonate (e.g. Alka Seltzer ®), are chosen for their ability to evolve a gas such as $CO_2$ when reacted with water. A desiccant 66 is provided in which pellets 64 are dispersed. Silica gel is used in preferred embodiments because it is polar and retains water. Besides silica gel, any suitable adsorbent such as diatomaceous earth, Fuller's earth, clay or activated alumina might be used.

Canister 24 is also provided with a window 68 made of transparent material such as impact resistant plastic or glass. Window 68 is an elongated, transversely oriented slot situated at about the midpoint of canister 24 so that the pellets 64 and desiccant 66 can be viewed to determine if moisture has seeped into the container and deactivated the contents thereof. If, for example, atmospheric moisture has broken through first seal 56 and entered the container, desiccant 66 will assume a damp appearance. Alternately, pellets 64 will be reduced in size, indicating that a reaction with water has taken place and carbon dioxide gas has been evolved which has slowly seeped out of canister 24. Either of these situations indicates that the contents of retriever 10 should be replaced.

In especially preferred embodiments, desiccant 60 can be provided with an indicator which changes color when wet to indicate the present of unwanted moisture in canister 24.

Desiccant 66, in combination with window 68, is an important aspect of this invention since retrievers 10 are often stored on boats or ships in damp environments. The material inside canisters such as those shown in U.S. Pat. No. 2,785,420 can adsorb moisture in such environments, while giving no external indication that such moisture has been adsorbed. In such a situation, the inoperable status of the retrieval canister is not made known until it fails to operate, at which time the submerged object is irretrievably lost.

In operation, retriever 10 is attached to an object 12 by tying or otherwise attaching anchor cord 14 to object 12. If and when object 12 is accidentally or purposely submerged in a body of water 20, latex first seal 56 is dissolved by water 20 and water (schematically demonstrated as arrows 70 in FIG. 2) enters canister 24 through aperture 38. When water 70 reaches the interior of canister 24 it encounters sponge 60 which abuts aperture 38 and substantially seals it. As water 70 is absorbed into sponge 60, it is conveyed through the openings in grated bracket 62 as well as upwardly along side wall 28 of canister 24.

When pellets 64 come in contact with water 70, a chemical reaction takes place in which a gas is evolved. For example, if sodium bicarbonate is used for pellets 64, carbon dioxide gas is evolved as a product of the reaction between water and sodium bicarbonate. The evolving gas is schematically illustrated by the three vertical arrows on the interior of canister 24.

When the gas reaches a great enough volume, cap 30 is forced out of canister 24. Since cap 30 is made of a floatable material such as polyurethane or cork, cap 30 floats to the surface 22 of water 20 to mark the position of submerged object 12. Cap 30 is maintained in place above object 12 by cord 40 which is attached to the interior of canister 24 at eyelet 50. Object 12 can then be retrieved by pulling on cap 30 and cord 40 to pull object 12 to the surface 22.

An important aspect of this invention is that sponge 60 is made of a material that expands when exposed to water. Accordingly, as water 70 soaks the sponge and is conveyed to the interior of the canister, sponge 60 also expands, as shown in FIG. 3. This expansion substantially plugs aperture 38 to interfere with the egress of carbon dioxide gas from the interior of canister 24. A more efficient buildup of gas volume in the interior of canister 24 is thereby permitted. This is a significant advance over the prior art in which evolving gas could merely escape through the same aperture which permitted the flow of fluid into the interior of canister 24.

I claim:

1. A retriever for a submerged object, comprising:

a canister having a cap-receiving opening and a sealed aperture;

a floatable cap for placement in selectively sealing relationship to said opening;

a retrieval cord for affixing said cap to said canister;

means for anchoring said canister to said submerged object;

a first seal for said aperture comprised of a water soluble layer affixed to said aperture on the exterior of said canister;

a second seal for said aperture comprising a water expandable sponge disposed in abutting relationship to said aperture in the interior of said canister, and a bracket for retaining said sponge against said aperture; and water activatable material for placement within said canister that evolves a gas when exposed to water.

2. The retriever of claim 1 further comprising a desiccant for placement within said canister to adsorb moisture.

3. The retriever of claim 2 wherein said water activatable material is comprised of pellets which are selected from the group consisting of carbides and bicarbonates capable of forming a gas upon reacting with water.

4. The retriever of claim 3 wherein said desiccant is silica gel.

5. The retriever of claim 4 wherein said bracket for retaining said sponge in fixed engagement against said aperture on the interior of said canister is comprised of a grate.

6. The retriever of claim 5 wherein said floatable cap is polyurethane.

7. The retriever of claim 6 wherein said canister is provided with a window through which the water activatable contents of said canister can be viewed.

8. The retriever of claim 7 wherein said water soluble first seal is a latex seal.

9. The retriever of claim 8 wherein said water expandable sponge is a compressed cellulose sponge.

10. A retriever for a submerged object, comprising:

a cylindrical canister provided with a closed end, an open, cap receiving end and a sealed aperture through one side wall of the canister;

a floatable, polyurethane cap for placement in selectively sealing relationship to said open end, said cap being comprised of a generally flat, circular top and an annular, downwardly depending skirt configured to fit snugly within the open end of said canister;

a retrieval cord anchored to said polyurethane cap and to the closed end of said cylindrical canister, the length of said retrieval cord being sufficient to reach the surface of the water in which the object is submerged;

an anchor cord for fixing said canister to said submerged object;

a first seal for said aperture comprising a latex coating over said aperture on the exterior of said canister;

a second seal for said aperture comprising a compressed cellulose sponge disposed in abutting relationship to said aperture in the interior of said canister, and a grated bracket for retaining said sponge in abutting relationship against said aperture such that said sponge upon exposure to water conveys water to the interior of the canister and expands to cause said sponge to seal the aperture;

water activatable pellets for placement within said canister that evolve a gas when exposed to water, said pellets being comprised of a water activatable material selected from the group consisting of carbides and bicarbonates capable of forming a gas upon reacting with water;

a silica gel desiccant for placement within said canister to adsorb atmospheric moisture; and a window disposed in one wall of said canister through which the water activatable contents and desiccant in said canister can be viewed.

* * * * *